US008607475B2

(12) United States Patent
Nakano

(10) Patent No.: US 8,607,475 B2
(45) Date of Patent: Dec. 17, 2013

(54) SHOCK ABSORBING FOOTWEAR CONSTRUCTION

(75) Inventor: Kiyotaka Nakano, Rockford, MI (US)

(73) Assignee: Wolverine World Wide, Inc., Rockford, MI (US)

( * ) Notice: Subject to any disclaimer, the term of this patent is extended or adjusted under 35 U.S.C. 154(b) by 511 days.

(21) Appl. No.: 12/819,630

(22) Filed: Jun. 21, 2010

(65) Prior Publication Data

US 2010/0251566 A1 Oct. 7, 2010

Related U.S. Application Data

(62) Division of application No. 11/739,854, filed on Apr. 25, 2007, now Pat. No. 7,757,411.

(51) Int. Cl.

| | |
|---|---|
| ***A43B 21/26*** | (2006.01) |
| ***A43B 13/00*** | (2006.01) |
| ***A43B 21/32*** | (2006.01) |

(52) U.S. Cl.

USPC ..... 36/37; 36/38; 36/27; 36/28

(58) Field of Classification Search

USPC ..... 36/28, 27, 35 R, 30 R, 103, 102

See application file for complete search history.

(56) References Cited

U.S. PATENT DOCUMENTS

| | | | | |
|---|---|---|---|---|
| 4,187,620 | A * | 2/1980 | Selner | 36/28 |
| 4,798,010 | A * | 1/1989 | Sugiyama | 36/30 R |
| 5,619,809 | A * | 4/1997 | Sessa | 36/3 R |
| 6,082,024 | A * | 7/2000 | Del Biondi | 36/28 |
| 6,685,011 | B2 * | 2/2004 | Nishiwaki et al. | 36/28 |
| 2001/0052194 | A1 * | 12/2001 | Nishiwaki et al. | 36/28 |

* cited by examiner

*Primary Examiner* — Jila M Mohandesi

(74) *Attorney, Agent, or Firm* — Warner Norcross & Judd LLP

(57) ABSTRACT

A footwear sole includes shock absorbing elements that extend from upper and lower plates. In one embodiment, the shock absorbing elements include a bridge defining a plurality of receptacles extending from the lower plate and a plurality of protrusions extending from the upper plate. Each protrusion is associated with one receptacle, and a portion of each protrusion extends into the receptacle.

11 Claims, 6 Drawing Sheets

SHOCK ABSORBING FOOTWEAR CONSTRUCTION

CROSS-REFERENCE TO RELATED APPLICATION

The present application is related to U.S. patent application Ser. No. 11/739,854, filed Apr. 25, 2007. The '854 application issued as U.S. Pat. No. 7,757,411 on Jul. 20, 2010.

BACKGROUND OF THE INVENTION

The present invention relates to footwear constructions, and more particularly to a footwear construction with a shock absorbing sole.

There is a continuing effort in the footwear industry to provide evermore comfortable and durable articles of footwear. In most applications, the comfort—often the combination of shock absorption and support—of the footwear construction is provided in the sole, and particularly the midsole.

A wide variety of sole constructions are known for providing the article of footwear with a desired amount of shock absorption and support. For instance, many articles of footwear include a layer or multiple layers of resilient cushioning material, such as a polyurethane or EVA foam. Some of these articles of footwear also incorporate hard plates into portions of the midsole to provide a level of rigidity for added support in those portions. More recently, footwear constructions have included alternative elements in the sole to achieve the desired amount of shock absorption and support. For instance, U.S. Pat. No. 5,353,523 discloses a midsole construction with a plurality of columnar resilient elements. The stiffness of these resilient elements can be controlled to meet the desired shock absorption characteristics for a variety of applications.

As the shock absorption and support capabilities of footwear continue to evolve, manufacturers are searching for footwear constructions that provide increased levels of control and comfort that are while also being durable, aesthetically pleasing, and cost effective to manufacture.

SUMMARY OF THE INVENTION

The present invention provides a footwear sole that includes a plurality of shock absorbing elements that extend from upper and lower plates.

In one embodiment, the present invention includes at least one first shock absorbing element extending upwardly from the lower plate, and at least one second shock absorbing element extending downwardly from the upper plate and engaging the first shock absorbing element. A resilient sleeve surrounds the first shock absorbing element and the second shock absorbing element, and extends substantially from the first plate to the second plate. In one embodiment, the lower plate includes a peripheral wall that extends upwardly to support the upper plate. The peripheral wall may be transparent, such that the shock absorbing elements are visible.

In one embodiment, the first shock absorbing elements are a plurality of receptacles extending from the lower plate and the second shock absorbing elements are a plurality of protrusions extending from the upper plate. Each protrusion is associated with one receptacle, and portion of each protrusion extends into the receptacle. A portion of each protrusion extends into one of the receptacles.

In another embodiment, a plurality of shock absorbing elements extend from a bridge on one of the upper and lower plates. The bridge is positioned to align with a plurality of the shock absorbing elements on the other plate. In one embodiment, the bridge includes a plurality of receptacles, wherein each receptacle is aligned with one of the protrusions to receive a portion of the protrusion. In one embodiment, the protrusions are aligned in spaced rows, and a bridge is associated with each row.

The present invention provides an enhanced shock absorbing sole that is durable and aesthetically pleasing. The combination of the first and second shock absorbing elements and the sleeve allows the support and shock absorption of the sole to be controlled to meet a wide variety of footwear applications.

These and other objects, advantages, and features of the invention will be fully understood and appreciated by reference to the description of the current embodiment and the drawings.

DESCRIPTION OF THE CURRENT EMBODIMENT

I. Overview

Figure 1:
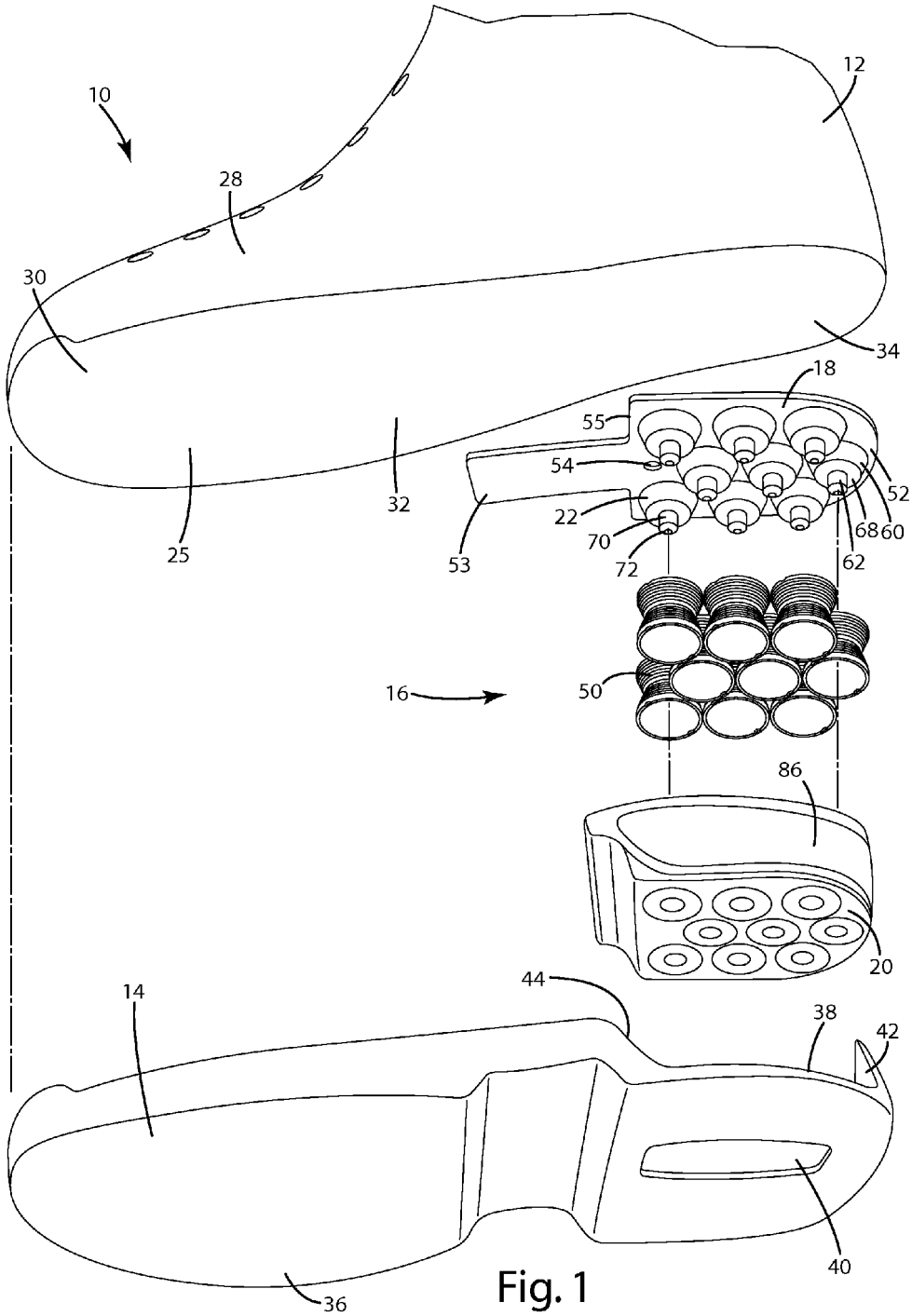
FIG. 1 is an exploded view of a footwear construction according to one embodiment of the present invention.
Figure 2:
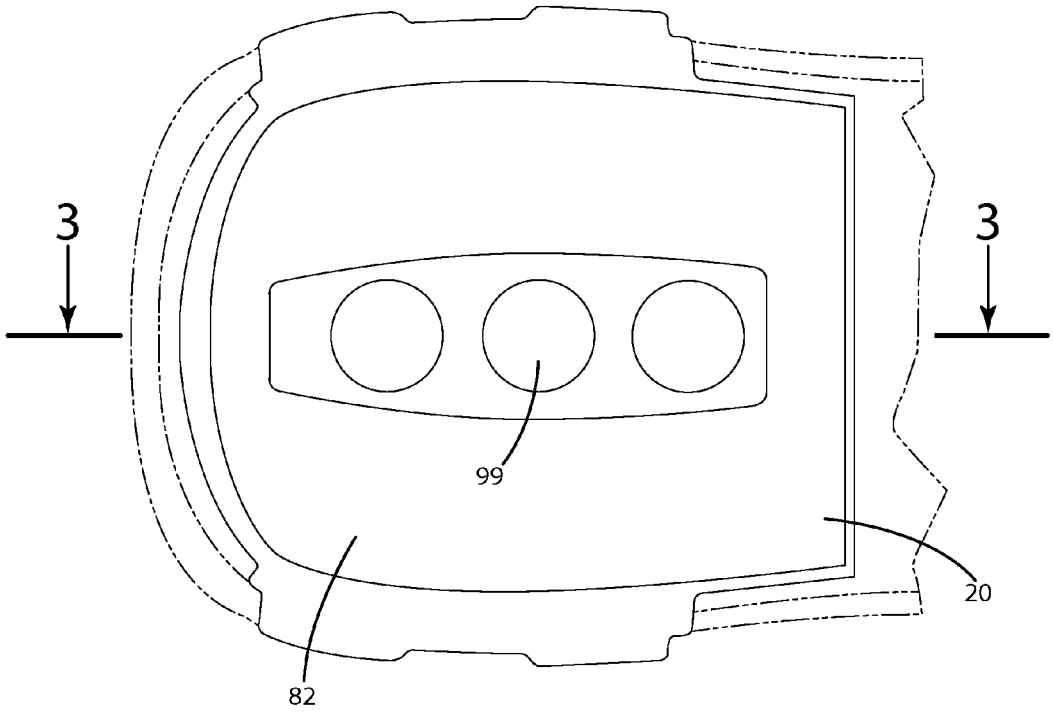
FIG. 2 is a bottom view thereof.

A footwear construction according to one embodiment of the present invention is shown in FIG. 1 and generally designated 10. The footwear construction 10 includes an upper 12, an outsole 14 and a shock absorbing device 16 between the upper 12 and the outsole 14. The shock absorbing device 16 is designed to absorb shock as the wearer's foot strikes the ground. In one embodiment, the device 16 includes an upper plate 18, a lower plate 20, a plurality of first shock absorbing elements 22 extending from the upper plate 18, a plurality of second shock absorbing elements 24 extending from the lower plate 20, and a plurality of resilient sleeves 50.

II. Structure

The upper 12 is conventional, and therefore will not be described in great detail. Suffice it to say that the upper includes a bottom 25 and vamp 28. The upper 12, along with the rest of the footwear construction 10, generally includes a forefoot region 30, an arch region 32 and a heel region 34. The outsole 14 includes a lower surface 36 that forms a wear surface for the footwear construction 10, and an upper surface 38. The lower surface 36 may include a variety of tread patterns (not shown), and the upper surface 38 is attached to the upper 12 and/or the lower plate 20 by a conventional method, such as an adhesive, stitching, or direct attach molding. In one embodiment, described in more detail below, the outsole 14 defines a cutout 40 that exposes a portion of the shock absorbing device 16. In the illustrated embodiment, the cutout 40 is located in the center of the heel region 34. In one embodiment, a portion of the upper surface 38 is designed to receive the shock absorbing device 16. For instance, in the illustrated embodiment, the upper surface 38 includes a rear wall 42 and a front wall 44 in the heel region 34 to retain the shock absorbing device 16. In an alternative embodiment, the footwear construction 10 may include a midsole or another component between the upper 12 and the outsole 14.

In one embodiment, the upper plate 18 is molded from plastic, such as TPU, TPR or PVC, and includes an upper surface 50 and a lower surface 52. A flange 53 may extend outwardly from the forward edge 55 to provide the footwear construction 10 with added support. In one embodiment, the upper surface 50 engages the bottom 25 of the upper 12, and the lower surface 52 faces the lower plate 20. The upper plate 18 may include a hole 54 extending through it that allows air to pass through the upper plate 18. In one embodiment, one or more first shock absorbing elements 22 extend from lower surface 52 of the upper plate 18. The first shock absorbing elements 22 may be molded integrally with the upper plate 18, or alternatively they may be attached to the upper plate 18 by an adhesive, a separate molding operation, or another method. Like the upper plate 18, the first shock absorbing elements 22 may be formed from a variety of materials, such as TPU, TPR, PVC or rubber. In one embodiment, the first shock absorbing elements 22 have a lower density than the upper plate 18, such that they are softer and provide more shock absorption than the upper plate 18.

Referring to FIGS. 1-4, in one embodiment, the first shock absorbing elements 22 are protrusions that extend from the lower surface 52 of the upper plate 18. The protrusions have a first portion 60 extending from the upper plate 18 and a second portion 62 extending from the first portion 60. The first portion 60 is generally frustoconical, including a base 64, a sidewall 66, and an outer edge 68. The second portion 62 is generally cylindrical, and has a diameter that is smaller than the diameter of the outer edge 68. The second portion 62 includes a sidewall 70 and a distal end 72. In the illustrated embodiment, the distal end 72 is rounded off or "dome-shaped." As shown, the second portion 62 extends outwardly from the first portion 60 approximately the same distance as the first portion 60 extends from the upper plate 18. Alternatively, one of the portions 60, 62 may extend outwardly a distance greater than the other.

In one embodiment, the lower plate 20 is molded from plastic, such as TPR, TPU or PVC. As shown in FIGS. 1-4, the lower plate 20 may include an upper surface 80, a lower surface 82 and a peripheral edge 84. In one embodiment, a peripheral wall 86 extends upwardly from the upper surface 80 at the peripheral edge 84 to form a shell. In one embodiment, the lower plate 20 and peripheral wall 86 are formed integrally as a single unitary piece. They may additionally be formed from a transparent material, such that the other elements of shock absorbing device are visible through the peripheral wall 86 and/or the lower plate 20. In one embodiment, the peripheral wall 86 includes a ledge 88 near the top edge 90 of the peripheral wall 86 that supports the upper plate 18.

Figure 3:
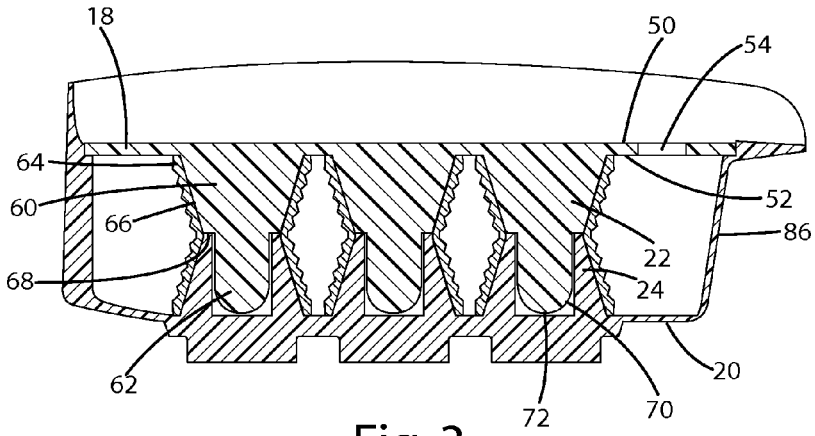
FIG. 3 is a side cross sectional view of a shock absorbing device according to the one embodiment, taken along line 3-3 in FIG. 2.
Figure 4:
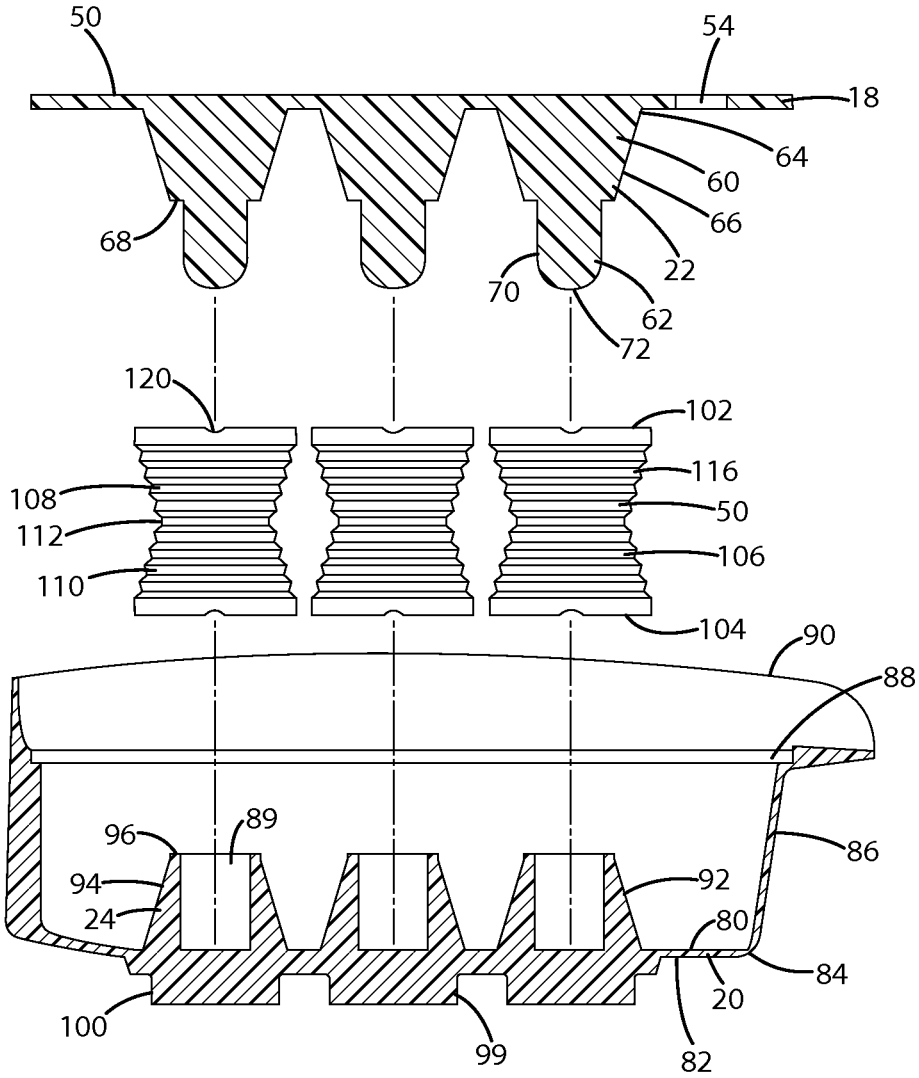
FIG. 4 is an exploded side cross sectional view thereof, taken along line 3-3 in FIG. 2.

In one embodiment, a plurality of second shock absorbing elements 24 extend from the lower plate 20, and are each positioned to align with one of the first shock absorbing elements 22. In the embodiment shown in FIGS. 1-4, the second shock absorbing elements 24 include a sidewall 92 that extends upwardly from the upper surface 80 of the lower plate 20. The sidewall 92 may include a tapered outer surface 94, such that the second shock absorbing elements 24 each have a frustoconical shape. In one embodiment, each of the second shock absorbing elements 24 includes a distal end 96 that defines a recess 98 extending into the second shock absorbing element 24. As shown in FIGS. 3 and 4, the recess 98 extends into the sidewall approximately to the upper surface 80 of the lower plate 20. The recess 98 is sized and shaped to receive the second portion 62 of one of the first shock absorbing elements. For instance, in the embodiment shown in FIGS. 1-4, the recess 98 is generally cylindrical. The second shock absorbing elements 24 may be molded from a variety of materials, and in one embodiment the second shock absorbing elements 24 are molded integrally with the lower plate 20 and the peripheral wall 86 as a unitary piece. In one embodiment, the second shock absorbing elements 24 are relatively stiff as compared to the first shock absorbing elements 22, such that they provide different compression and shock absorption. The second shock absorbing elements 24 may be disposed on the lower plate 20 in a variety of different amounts and patterns. In the illustrated embodiment, both the first 22 and second 24 shock absorbing elements are disposed in three rows of three generally aligned in the front-to-back direction. In one embodiment, the lower surface 82 of the lower plate 20 includes protrusions 99 that extend outwardly from the lower surface 82 opposite each of the second shock absorbing elements in the central row 100 of second shock absorbing elements 24. When assembled, this central row 100 of second shock absorbing elements 24 is aligned with the cutout 40 in the heel region 34 of the outsole 14.

The sleeves 50 are generally resilient, and are shaped to surround the first 22 and second 24 shock absorbing elements. The sleeves 50 may be formed from a variety of materials, such as TPU, TPR or PVC, and they include an upper edge 102, a lower edge 104, and a sidewall 106 extending therebetween. In one embodiment, shown in FIGS. 1, 3 and 4, the sidewall 106 includes a first portion 108, a second portion 110 and a center 112. The first and second portions 108, 110 taper as they extend towards the center 112, such that the sleeve 50 has an hourglass shape. The sidewall 106 may include a plurality of ridges 116. In one embodiment, the ridges 116 are triangular. As shown in FIG. 4, the upper edge 102 and lower edge 104 of the sleeve 50 may define notches 120 that extend through the sidewall 106. In the illustrated embodiment, the notches 120 are approximately semi-circular, however, the may have a variety of alternative shapes. In an alternative embodiment, the notches 120 may be cutouts that are located inward of the edges 102, 104. In one embodiment, the sleeves 50 are sized to extend from the upper plate 18 to the lower plate 20. Alternatively, the sleeves 50 could be shorter, such that they do not compress until the plates 18 and 20 have been compressed together a desired distance, or they could be taller, such that they are under constant compression when assembled.

III. Assembly

The assembly of the footwear construction 10 includes forming the upper plate 18 with the first shock absorbing elements 22 and forming the lower plate 20 with the second shock absorbing elements 24 (or attaching the shock absorbing elements 22, 24 to the first and second plates). According to the embodiment shown in FIGS. 1-4, the sleeves 50 may be placed on the lower plate 20, with one sleeve 50 extending around each of the second shock absorbing elements 24. The upper plate 18 is then positioned above the lower plate 20 such that each of the first shock absorbing elements 22 aligns with one of the second shock absorbing elements 24. In one embodiment, the plates 18 and 20 are brought together until the upper plate 18 contacts the ledge 88 on the peripheral wall 86. As the plates 18, 20 are brought together, the second portion 62 of each of the first shock absorbing elements 22 is inserted into the recess 98 of one of the second shock absorbing elements 24. As shown, in FIG. 3, in this position, the first portion 60 of the first shock absorbing elements 22 contacts the distal edge 96 of the second shock absorbing elements 24. The distal end 72 of the first shock absorbing elements 22 extends into the recess 98, but does not contact the upper surface 80 of the lower plate 20. The remaining parts of the footwear construction 10, such as the upper 12 and outsole 14, are attached to the upper 18 and lower 20 plates, or other components, by conventional methods. In one embodiment, when the outsole 14 is attached to the shock absorbing device 16, the lower surface 82 of the lower plate 20 is visible through the cutout 40.

It should be noted that the heights of each of the components of the first 22 and second 24 shock absorbing elements may be varied to meet the desired levels of compression and shock absorption for the footwear construction 10. For instance, some of the components, such as the sleeves 50 or the shock absorbing elements 22, 24 may be taller, such that they are under constant compression when assembled. Alternatively, some of the components may be shorter, such that they do not compress until the plates 18, 20 have been moved together a desired amount. In addition, some or all of the first shock absorbing elements 22 and second shock absorbing elements 24 could be reversed, such that the protrusions extend from the lower plate 20 and the receptacles extend from the upper plate 18.

IV. Second Embodiment

Figure 5:
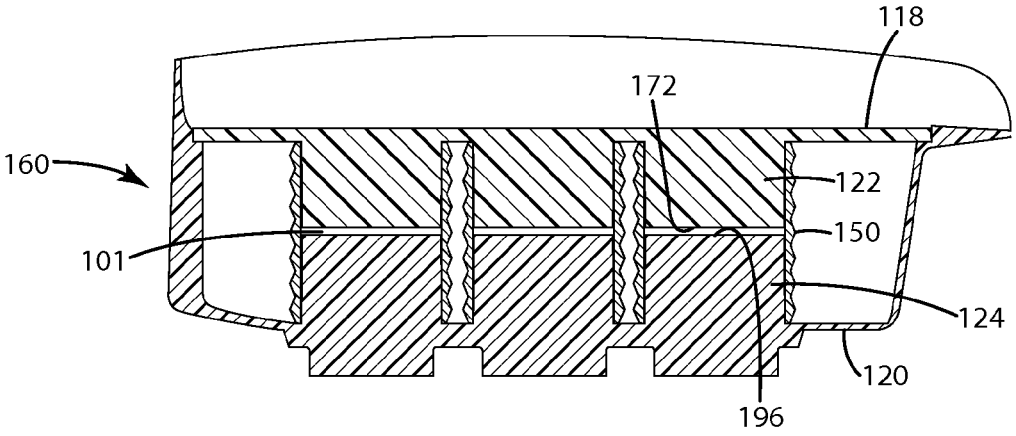
FIG. 5 is a side cross sectional view of a shock absorbing device according to a second embodiment.
Figure 6:
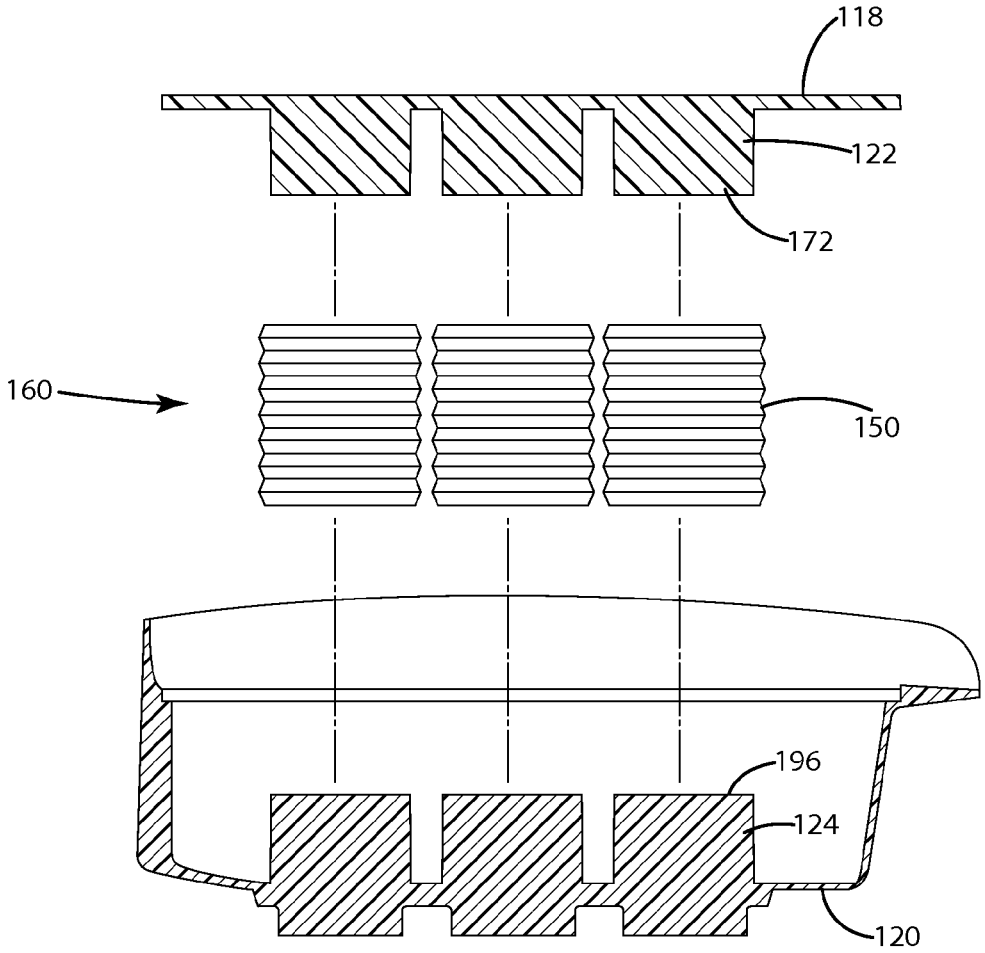
FIG. 6 is an exploded side cross sectional view of a shock absorbing device according to the second embodiment

A second embodiment of the shock absorbing device 160 is shown in FIGS. 5-6. In the second embodiment, the first 122 and second 124 shock absorbing elements are generally cylindrical. The first shock absorbing elements 122 extend from the upper plate 118, and the second shock absorbing elements 124 extend upwardly from the lower plate 120. In one embodiment, as shown in FIG. 5, the upper 118 and lower 120 plates fit together such that there is a gap 101 between the distal end 172 of the first shock absorbing element 122 and the distal end 196 of the second shock absorbing element 124. The first 122 and second 124 shock absorbing elements have approximately the same diameter, such that the distal ends 172, 196 can contact each other and compress against each other. The sleeves 50 are generally cylindrical, and extend from the upper plate 180 to the lower plate 120. In this embodiment, the shock absorbing device 160 compresses the sleeve 150 alone until the gap 101 is closed, and then compresses both the sleeve 150 and the shock absorbing elements 122, 124.

V. Third Embodiment

Figure 7:
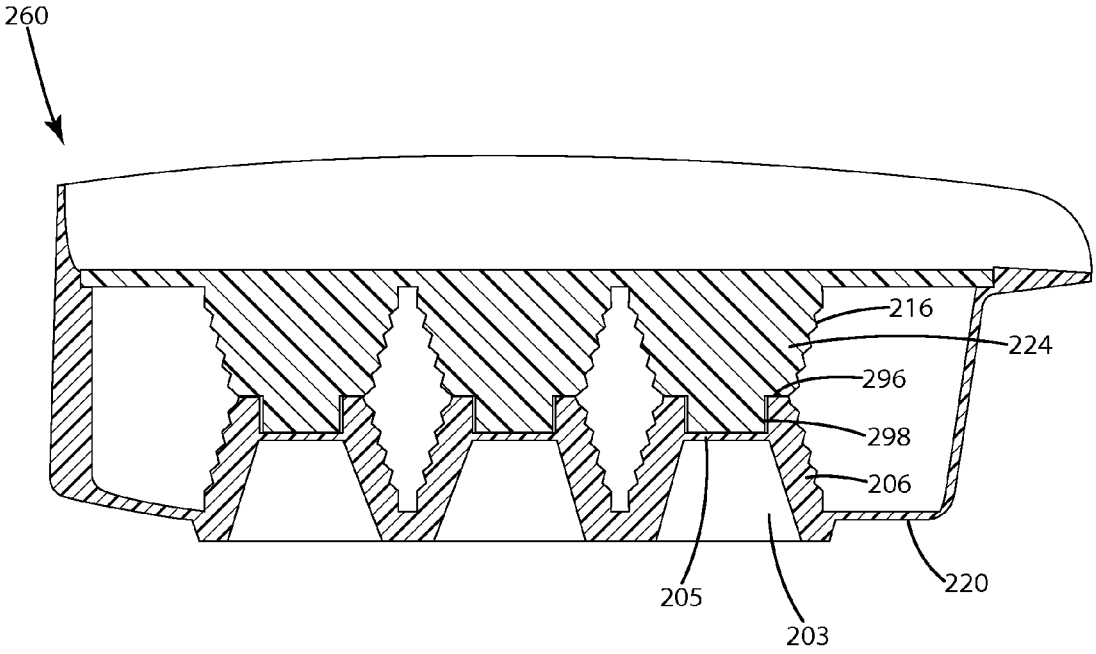
FIG. 7 is a side cross sectional view of a shock absorbing element according to a third embodiment.

A third embodiment of the shock absorbing device 260 is shown in FIG. 7. In this embodiment, the lower plate 220 includes indentations 203 opposite each of the second shock absorbing elements 224 such that the second shock absorbing elements 224 have a greater degree of flexibility and shock absorption. As in the first embodiment, the distal end 296 of the second shock absorbing elements 224 defines a recess 298; however, the recess 298 extends into the second shock absorbing element 224 to a wall 205 within the sidewall 206. In this embodiment, the sleeve may be eliminated. The triangular ridges 216 may extend directly from the first 122 and second 124 shock absorbing elements. Alternatively, the sleeves may be included.

VI. Fourth Embodiment

Figure 8:
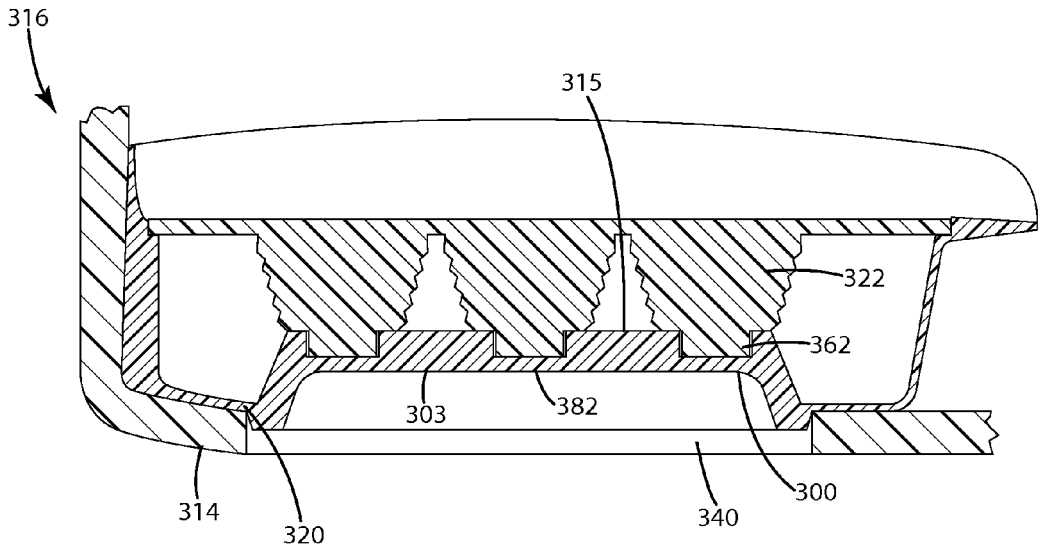
FIG. 8 is a side cross sectional view of a shock absorbing element according to a fourth embodiment.
Figure 9:
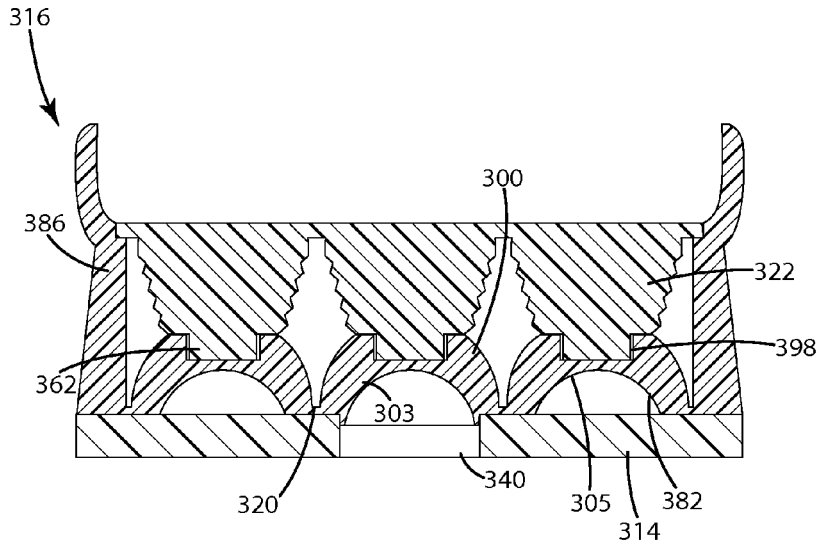
FIG. 9 is a front cross sectional view of the shock absorbing element of the fourth embodiment.

A fourth embodiment of the shock absorbing device 316 is shown in FIGS. 8-9. This embodiment differs from the FIG. 7 embodiment in that the lower plate 320 includes a plurality of elongated bridges 303 that extend upwardly from the lower plate 320. As shown in FIGS. 8 and 9, in one embodiment, the lower plate 320 includes three bridges 303, each aligned with one of the rows of first shock absorbing elements 322. The lower surface 382 of the lower plate 320 includes elongated indentations 305 extending under each of the bridges 303. As shown in FIG. 9, in one embodiment, the indentations 303 have an arc shaped front-to-back cross section. The upper surface 315 of each bridge 303 defines a plurality of recesses 398, each aligned to receive the second portion 362 of one of the first shock absorbing elements 322. In one embodiment, the central bridge 300 is sized approximately the same as the cutout 340 in the outsole 314, such that the central bridge 300 is visible. As in the other embodiments, the peripheral wall 386 extending from the lower plate 320 may be transparent such that the shock absorbing device 316 is visible through the wall 386. As in the FIG. 7 embodiment, in this embodiment, the sleeves may be eliminated. However, one or more elongated sleeves (not shown) could be included to surround each bridge and its corresponding row of first shock absorbing elements 322.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A footwear sole comprising:

an upper plate including a plurality of downwardly extending shock absorbing protrusions, said protrusions having a first portion extending down from said upper plate and a second portion extending from said first portion, said second portion including a distal end;

a lower plate spaced from the upper plate and including an elongated bridge extending upwardly from said lower plate towards said upper plate, said elongated bridge engaging said distal end of at least two of said protrusions; and an outsole adjacent said lower plate, said elongated bridge spaced above said outsole;

wherein said lower plate includes an upper surface and a lower surface, said elongated bridge disposed on said upper surface, said lower surface defining an elongated indentation extending continuously under said elongated bridge and at least two of said protrusions.

2. The footwear sole of claim 1 wherein said elongated bridge includes a distal edge defining a plurality of recesses, said distal end of each of said at least two protrusions extending into one of said recesses.

3. The footwear sole of claim 1 wherein said lower plate includes a plurality of elongated bridges.

4. The footwear sole of claim 3 wherein said protrusions are aligned in rows, each elongated bridge associated with one of said rows of protrusions.

5. The footwear sole of claim 1 wherein said upper plate and said protrusions are formed integrally from one piece, said upper plate having a greater density than said protrusions.

6. The footwear sole of claim 1 wherein said elongated bridge includes an arc-shaped longitudinal cross section.

7. The footwear sole of claim 1 including an outsole, said outsole defining a cutout, said elongated bridge aligned with said cutout such that said elongated bridge is visible through said cutout.

8. The footwear sole of claim 7 including a plurality of elongated bridges, wherein a central one of said elongated bridges is aligned with said cutout.

9. The footwear sole of claim 1 including a peripheral wall extending from said upper plate to said lower plate.

10. The footwear sole of claim 9 wherein at least a portion of said peripheral wall is transparent, such that said elongated bridge is visible through said peripheral wall.

11. The footwear sole of claim 2 wherein said first portion of each said protrusion engages said distal edge of said elongated bridge.

* * * * *